US011590514B2

(12) United States Patent
Yuan et al.

(10) Patent No.: US 11,590,514 B2
(45) Date of Patent: Feb. 28, 2023

(54) COLLECTORS FOR TREATING TAILINGS

(71) Applicant: SYNCRUDE CANADA LTD. in trust for the owners of the Syncrude Project as such owners exist now and in the future, Fort McMurray (CA)

(72) Inventors: Simon Yuan, Edmonton (CA); James Lorentz, Fort McMurray (CA); Ron Siman, Edmonton (CA)

(73) Assignee: SYNCRUDE CANADA LTD, Calgary (CA), in trust for the owners of the Syncrude Project as such owners exist now and in the future ( * ) Notice: Subject to any disclaimer, the term of this patent is extended or adjusted under 35 U.S.C. 154(b) by 674 days.

(21) Appl. No.: 16/664,362

(22) Filed: Oct. 25, 2019

(65) Prior Publication Data

US 2020/0129991 A1 Apr. 30, 2020

Related U.S. Application Data

(60) Provisional application No. 62/751,347, filed on Oct. 26, 2018.

(51) Int. Cl.
*B03D 1/01* (2006.01)
*B03D 1/02* (2006.01)
(Continued)

(52) U.S. Cl.
CPC ..... *B03D 1/025* (2013.01); *B03D 1/002* (2013.01); *B03D 1/008* (2013.01); *B03D 1/011* (2013.01);
(Continued)

(58) Field of Classification Search
CPC ..... B03D 1/025; B03D 1/002; B03D 1/008; B03D 1/011; B03D 1/016; B03D 1/10;
(Continued)

(56) References Cited

U.S. PATENT DOCUMENTS 2,208,143 A * 7/1940 Weinig ..... B03D 1/02 209/166
2,769,540 A * 11/1956 Brown ..... B03D 1/002 423/340
(Continued)

FOREIGN PATENT DOCUMENTS

CA 2942910 A1 9/2015
CA 2909388 C 10/2016
(Continued)

OTHER PUBLICATIONS

Chen X.Q., Ma J.W., Chen X.H., Chen Z.Y. and Chen Z.H. (2008). Study of middle-low grade bauxite desilication by bi-flotation technology. Proceedings XXIV International Mineral Processing Congress, D. Wang, C. Sun, L. Zhang and L. Han (eds), Beijing, China, pp. 1447-1454.
(Continued)

*Primary Examiner* — Joseph W Drodge
(74) *Attorney, Agent, or Firm* — Bennett Jones LLP

(57) ABSTRACT

A process for treating and dewatering tailings comprising fine clay minerals, fine rock-forming minerals and water is provided, comprising treating the tailings with a sufficient amount of a collector to modify the surface properties of both the fine clays and rock-forming minerals; subjecting the treated tailings to froth flotation to form a fine clays and rock-forming minerals froth layer; and recovering the froth layer and subjecting it to dewatering.

16 Claims, 12 Drawing Sheets

(51) Int. Cl.

| | |
|---|---|
| ***B03D 1/10*** | (2006.01) |
| ***C10G 1/04*** | (2006.01) |
| ***B03D 1/002*** | (2006.01) |
| ***B03D 1/016*** | (2006.01) |
| ***B03D 1/008*** | (2006.01) |

(52) U.S. Cl.
CPC ..... *B03D 1/016* (2013.01); *B03D 1/10* (2013.01); *B03D 2201/002* (2013.01); *B03D 2201/02* (2013.01); *C10G 1/04* (2013.01)

(58) Field of Classification Search
CPC ..... B03D 2201/002; B03D 2201/02; B03D 1/01; B03D 2203/006; B03D 1/006; B03D 1/02; B03D 1/08; C10G 1/04; C02F 11/12; C02F 11/121; C02F 11/127; C02F 11/14; C02F 11/143; C02F 11/147; C02F 11/148
See application file for complete search history.

(56) References Cited

U.S. PATENT DOCUMENTS

| | | | | |
|---|---|---|---|---|
| 3,331,505 | A * | 7/1967 | Mercade | B03D 1/008 209/11 |
| 3,337,048 | A * | 8/1967 | Mercade | B03D 1/002 106/486 |
| 3,425,546 | A * | 2/1969 | James | B03D 1/08 209/11 |
| 3,498,674 | A * | 3/1970 | Matthews | E21B 43/29 299/5 |
| 4,883,586 | A * | 11/1989 | Bierman | B03B 9/00 209/166 |
| 4,968,413 | A * | 11/1990 | Datta | C10G 1/04 208/390 |
| 11,124,706 | B2 * | 9/2021 | Omotoso | B09B 3/21 |
| 2007/0209971 | A1 * | 9/2007 | Duyvesteyn | C10G 1/047 208/391 |
| 2011/0011589 | A1 * | 1/2011 | Zhang | E21B 43/006 166/305.1 |
| 2012/0181029 | A1 * | 7/2012 | Saini | C04B 40/0633 977/962 |
| 2013/0134074 | A1 * | 5/2013 | Soane | B03D 1/026 209/162 |
| 2014/0054232 | A1 * | 2/2014 | Duttlinger, Jr. | C02F 1/54 210/199 |
| 2014/0144290 | A1 * | 5/2014 | Martins | B03D 1/02 75/330 |
| 2014/0158631 | A1 | 6/2014 | Govind | |
| 2015/0046090 | A1 * | 2/2015 | Chieffo | G01N 33/241 702/2 |
| 2016/0272525 | A1 * | 9/2016 | Moffett | C10G 1/045 |
| 2016/0310964 | A1 | 10/2016 | Yuan et al. | |
| 2016/0311709 | A1 | 10/2016 | Yuan et al. | |
| 2017/0267557 | A1 | 9/2017 | Yuan et al. | |
| 2017/0335200 | A1 * | 11/2017 | Moran | C10G 1/045 |
| 2022/0010226 | A1 * | 1/2022 | Yoon | B03B 9/00 |

FOREIGN PATENT DOCUMENTS

| | | |
|---|---|---|
| CA | 2912898 C | 10/2016 |
| CA | 2924305 C | 9/2017 |
| GB | 1224877 | 3/1971 |

OTHER PUBLICATIONS

Laskowski U.S., Yuan X.M., and Alonso E.A. (2008). Potash ore flotation—How does it work? Proceedings XXIV International Mineral Processing Congress, D. Wang, C. Sun, L. Zhang and L. Han (eds), Beijing, China, pp. 1270-1276.

Qiu Y.Q., Mao S., and Zhang Q. (2008). Research on the effects of flotation recovery in bauxite desilication by treatment of middling. Proceedings XXIV International Mineral Processing Congress, D. Wang, C. Sun, L. Zhang and L. Han (eds), Beijing, China, pp. 1385-1389.

Zhang L.X., Chen X.Q. and Liu X. (2008). Review of flotation desilication on diasporic bauxite. Proceedings XXIV International Mineral Processing Congress, D. Wang, C. Sun, L. Zhang and L. Han (eds), Beijing, China, pp. 1485-1492.

Zhang L., Zhang L.M., Hu Y.H., Cao X.F. and Ouyang K. (2008). Study on mechanism of N,N-alkyl Dodecylamine in flotation of kaolinite and diaspore. Proceedings XXIV International Mineral Processing Congress, D. Wang, C. Sun, L. Zhang and L. Han (eds), Beijing, China, pp. 1580-1586.

* cited by examiner

COLLECTORS FOR TREATING TAILINGS

FIELD OF THE INVENTION

The present invention relates generally to a process for dewatering tailings such as oil sand tailings and, more particularly, to the use of collectors to modify the hydrophobicity of the fine minerals present in the tailings.

BACKGROUND OF THE INVENTION

Extraction tailings, such as oil sand extraction tailings, are generated from extraction operations that separate valuable material from the mined ore. In the case of oil sand ore, heavy oil or bitumen is extracted from the ore using water, which is added to the oil sand ore to enable the separation of the valuable hydrocarbon fraction from the oil sand minerals.

Oil sand generally comprises water-wet sand grains held together by a matrix of viscous heavy oil or bitumen. Bitumen is a complex and viscous mixture of large or heavy hydrocarbon molecules which contain a significant amount of sulfur, nitrogen and oxygen. The extraction of bitumen from sand using hot water processes yields large volumes of tailings composed of coarse sand, fine rock-forming minerals (e.g., quartz and feldspar), clays (e.g., kaolinite, illite and smectite), and residual bitumen which have to be contained in a tailings pond. Mineral fractions with a particle diameter equal to or less than 44 microns are collectively referred to as "fines".

Tailings produced during bitumen extraction are typically 50% water and 50% solids by weight. The solids fraction can be further defined as being either fine or coarse solids. Typically, the solid fraction contains 80% coarse and 20% fines by weight. Conventionally, extraction tailings have been transported to a deposition site contained within a dyke structure generally constructed by placing the coarse sand fraction of the tailings on beaches. The process water, unrecovered hydrocarbons, together with sand and fine materials that are not trapped in the dyke structure flow into a pond, where the coarse sand settles quickly to the bottom of the pond while the finer mineral solids such as rock-forming minerals and clays remain in suspension (referred to herein as "thin fine tailings").

The thin fine tailings suspension is typically 85% water and 15% fine particles (solids less than 44 μm) by mass with a sand-to-fines ratio (SFR) of less than 1. The thin fine tailings generally consists of about 76% clay minerals (55% kaolinite, 20% illite, and 1% mixed layers) and 24% rock-forming minerals (19% quartz, 3% siderite, 1% plagioclase, and 1% K-feldspar). Dewatering of thin fine tailings occurs very slowly. After a few years when the thin fine tailings have reached a solids content of about 30-35%, they are often referred to as mature fine tailings (MFT), which tailings behave as a fluid-like colloidal material. The more generic term, fluid fine tailings (FFT), is often used in the industry to define all oil sand tailings fractions which are comprised primarily of fines. FFT is generally defined as a liquid suspension of oil sands fines in water with a solids content greater than 2% and having less than an undrained shear strength of 5 kPa.

The fact that fluid fine tailings behave as a fluid and have very slow consolidation rates significantly limits options to reclaim tailings ponds. It is believed that the presence of large amounts of clay in the fluid fine tailings is the major contributor to its very slow consolidation. Thus, a challenge facing the industry remains the removal of water from the fluid fine tailings to strengthen the deposits so that they can be reclaimed and no longer require containment.

Recently, a method for dewatering oil sands tailings, in particular, fine tailings and fluid fine tailings comprising fine clays, fine rock-forming minerals, and water, has been proposed in Canadian Patent No. 2,912,898, which involves selectively floating the fine clay minerals, thereby rendering the remaining flotation tails comprised of rock-forming minerals more amenable to dewatering and consolidation. In particular, fine tailings or fluid fine tailings are treated with a clay surface reagent, such as a cationic collector, which is selective for clays and renders the clays more hydrophobic, prior to subjecting the tailings to flotation. This results in effective separation of the clay minerals (as clay froth) from the non-clay minerals, i.e., rock-forming minerals such as quartz and feldspar (as flotation tails).

Because the floated clay minerals in the clay froth have been rendered hydrophobic by surface modification by the clay surface reagent, such as a cationic collector, a large portion of water is quickly drained from the clay froth, while the clay froth is rapidly drying in air (naturally desiccating) due to its high porous structure. The clay froth can also be dewatered using filtration, pressure filtration, belt filtration, etc. The flotation tails are easier to process because of the reduced fine clays and may be readily settled.

One drawback of the method in Canadian Patent No. 2,912,898, however, is that there are now two tailings products, i.e., clay froth and flotation tails, to dewater. While both products are readily dewatered, it may be desirable to have a single product that is as readily dewatered as the clay froth or flotation tails.

Another recent method for dewatering oil sands tailings, in particular, fluid fine tailings comprising fine clays, has been proposed in Canadian Patent No. 2,909,338, which involves initially treating the tailings with a flocculant, a coagulant, or both, followed by treatment with a clay surface reagent such as a cationic collector. The treated tailings can then be subjected to liquid solids separation, such as in a gravity thickener, a hydrocyclone, a centrifuge, a vacuum filter or a filter press, rim ditching (accelerated dewatering), self-weight consolidation, etc.

SUMMARY OF THE INVENTION

The current application is directed to a process for dewatering oil sand tailings, in particular, thin fine tailings and fluid fine tailings, comprising fine clays, fine rock-forming minerals, and water, by treating the tailings with a collector that will render both the clays and rock-forming minerals more hydrophobic and then subjecting the treated tailings to flotation. It was discovered that when using certain collectors, essentially a single product is produced, i.e., a froth product, that comprises both clay and rock-forming minerals, which is amenable to dewatering and consolidation.

Thus, broadly stated, in one aspect of the present invention, a process of treating and dewatering tailings comprising fine clays, rock-forming minerals, and water is provided, comprising:

- treating the tailings with a sufficient amount of a collector to modify the surface properties of both the fine clays and rock-forming minerals;
- subjecting the treated tailings to froth flotation to form a fine clays and rock-forming minerals froth layer; and
- recovering the froth layer and subjecting it to dewatering.

In one embodiment, the tailings are first treated with a flocculant, coagulant, or both prior to treatment with a collector of the present invention. In one embodiment, the froth layer is dewatered by drainage and air drying. In another embodiment, the froth layer is dewatered by filtration, pressure filtration, belt filtration and the like.

In another aspect of the present invention, a process of treating and dewatering tailings comprising fine clays, rock-forming minerals, and water is provided, comprising:

mixing the tailings with an amount of a flocculant, a coagulant, or both, to promote flocculation or coagulation of both the fine clays and rock-forming minerals and form a first treated tailings;

treating the first treated tailings with a sufficient amount of a collector to modify the surface properties of the flocculated/coagulated fine clays and rock-forming minerals and form a second treated tailings; and subjecting the second treated tailings to liquid solids separation to yield a solids product for reclamation and a liquid product for recycling or disposal.

In one embodiment, the liquid solids separation takes place in a gravity separator, a thickener, a centrifuge, a filter press or a settling basin.

In one aspect, it was discovered that quaternary amines were capable of rendering both the clays and the rock-forming minerals present in fluid fine tailings (FFT) hydrophobic, thereby improving the dewatering characteristics of FFT. Further, it was discovered that quaternary amines are more soluble in oil sand recycle water and, therefore, can be easily prepared. Preferred quaternary amines are dodecylpyridinium chloride (DPC) having the formula

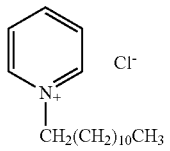

and benzyldimethyldodecylammonium chloride (BDDA) having the formula

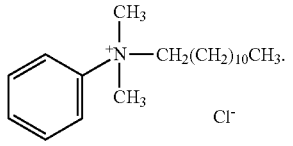

In another aspect, it was discovered that ether amines and ether diamines were also capable of rendering both the clays and rock-forming minerals present in fluid fine tailings (FFT) hydrophobic, thereby improving the dewatering characteristics of FFT. Ether amines and ether diamines are generally liquid and are easy to disperse in oil sand recycle water. Thus, they can be easily prepared and applied, and, in some instances, they can be added as a neat liquid without any preparation.

Ether amines have the general formula R—O—$CH_2CH_2CH_2NH_2$ and particularly useful ether amines are where R is $C_6H_{13}$, branched $C_8H_{17}$, $C_8H_{17}$, $C_{10}H_{21}$, branched $C_{10}H_{21}$, $C_{12}H_{25}$, $C_{14}H_{29}$, branched $C_{13}H_{27}$, or $C_{15}H_{31}$. Particularly useful is isodecyloxypropyl amine.

Ether diamines have the general formula

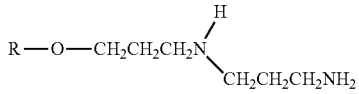

where R is $C_8H_{17}$, $C_{10}H_{21}$, branched $C_{10}H_{21}$, $C_{12}H_{25}$, $C_{14}H_{29}$, or branched $C_{13}H_{27}$. Particularly useful is isodecyloxypropyl-1,3-diaminopropane.

In one embodiment, the tailings are oil sands tailings. In one embodiment, the tailings are fluid fine tailings derived from oil sands operations. In one embodiment, the tailings are fluid fine tailings present in a tailings pond and the collector is added to the fluid fine tailings in situ.

In another aspect, the collector scheme comprises a metal cation and an anionic collector or a cationic polymer and an anionic collector. In one embodiment, the metal cation is $Fe^{2+}$ and the anionic collector is a C-18 fatty acid or a C-12 fatty acid. In another embodiment, the cationic polymer is a nano-hybrid polymer (NHP) and the anionic collector is a C-18 fatty acid or a C-12 fatty acid.

Additional aspects and advantages of the present invention will be apparent in view of the description, which follows. It should be understood, however, that the detailed description and the specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will now be described by way of an exemplary embodiment with reference to the accompanying simplified, diagrammatic, not-to-scale drawings.

DETAILED DESCRIPTION OF PREFERRED EMBODIMENTS

Figure 1:
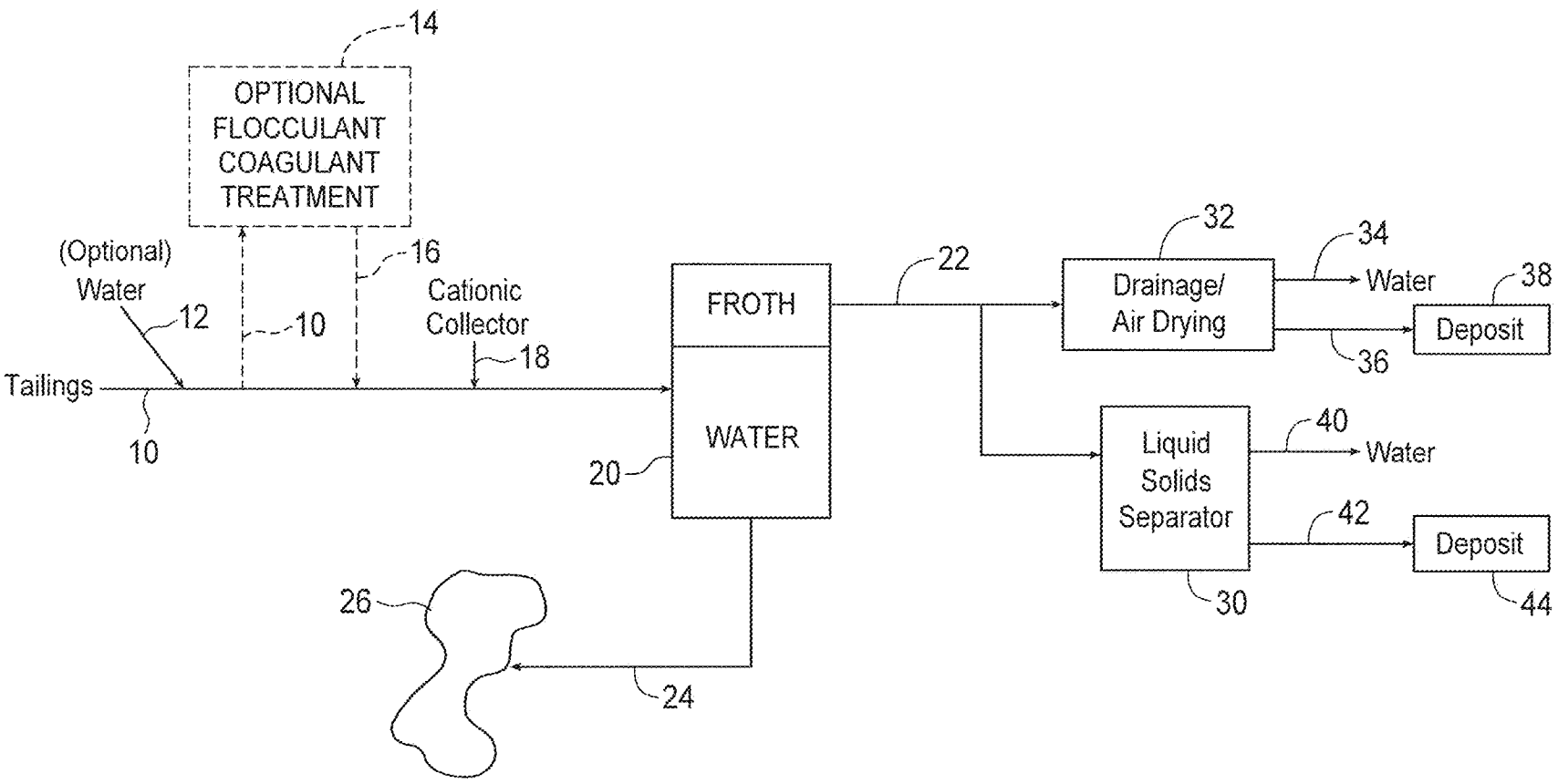
FIG. 1 is a schematic of one embodiment of the present invention for dewatering oil sands tailings.

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practised without these specific details.

The present invention relates generally to a process for dewatering tailings such as oil sands tailings, in particular, thin fine tailings and fluid fine tailings, comprising fine clays, fine rock-forming minerals, and water, by treating the tailings with a collector that will render both the clays and rock-forming minerals more hydrophobic. It was discovered that when using certain collectors and then subjecting the treated tailings to froth flotation, essentially a single product is produced, i.e., a froth product, that comprises both clay and rock-forming minerals, which is amenable to dewatering and consolidation. It was further discovered that when treating tailings with a flocculant, coagulant, or both, followed by treating the tailings with a collector that will render both the clays and rock-forming minerals in the flocs more hydrophobic resulted in a product that was much more amenable to liquid-solids separation, as all of the minerals in the flocs have been rendered hydrophobic.

Electrokinetic studies show that both rock-forming minerals such as quartz and feldspar and clays such as kaolinite, illite and smectite are negatively charged under commercial oil sands operation (e.g., where the tailings streams have a pH of about 8.0 to 8.5 due to the addition of NaOH during extraction). Both silts and clays are hydrophilic. However, generally, rock-forming minerals are more negatively charged than clays because of clays being structured as the layered arrangement of silica and alumina. Hence, certain cationic collectors may only selectively alter the clay particle surfaces from hydrophilic to hydrophobic, while the rock-forming minerals still remain fairly hydrophilic. Thus, the present invention is directed toward those cationic collectors that can render both clay minerals and rock-forming minerals hydrophobic.

With some tailings, however, when the clay minerals and rock-forming minerals are particularly small, mineral size can be enlarged to an optimum size range for flotation. For example, the minerals can be flocculated by adding a flocculant such as anionic polyacrylamides (APAM) or a cationic nano-hybrid polymer (NHP). In one embodiment, a coagulant could also be added or, in the alternative, used instead of a flocculant.

As used herein, wt % and % are used interchangeably and it is understood that all percentages herein are wt %, e.g., wt % of the oil sand ore being processed.

As used herein, the term "tailings" means any tailings produced during a mining operation and, in particular, tailings derived from oil sands extraction operations that contain a fines fraction. The term is meant to include fluid fine tailings (FFT) from oil sands tailings ponds and fine tailings from ongoing oil sands extraction operations (for example, flotation tailings, PSV underflow or froth treatment tailings) which may or may not bypass a tailings pond. In one embodiment, the tailings are primarily FFT, including mature fine tailings (MFT), obtained from oil sands tailings ponds given the significant quantities of such material to reclaim. However, it should be understood that the fine tailings treated according to the process of the present invention are not necessarily obtained from a tailings pond, and may also be obtained from ongoing oil sands extraction operations.

As used herein, the term "flocculation" refers to a process of contact and adhesion whereby the particles of a dispersion form larger-size clusters in the form of flocs or aggregates. As used herein, the term "flocculant" refers to a reagent which promotes flocculation by bridging colloids and other suspended particles in liquids to aggregate, forming a floc. Flocculants useful in the present invention are generally anionic polymers, which may be naturally occurring or synthetic, having relatively high molecular weights. In one embodiment, the dosage of the anionic polymeric flocculant ranges from between about 0 to about 1500 grams per tonne of solids in the tailings.

Suitable natural polymeric flocculants may be polysaccharides such as guar gum, gelatin, alginates, chitosan, and isinglass. Suitable synthetic polymeric flocculants include, but are not limited to, polyacrylamides, for example, a high molecular weight, long-chain modified polyacrylamide (PAM). PAM is a polymer $(—CH_2CHCONH_2—)_n$ formed from acrylamide subunits with the following structure:

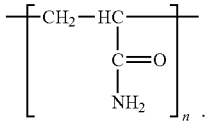

It can be synthesized as a simple linear-chain structure or cross-linked, typically using N,N'-methylenebisacrylamide to form a branched structure. Even though such compounds are often called "polyacrylamide," many are copolymers of acrylamide and one or more other chemical species, such as an acrylic acid or a salt thereof. The "modified" polymer is thus conferred with a particular ionic character, i.e., changing the anionicity of the PAM. Preferably, the polyacrylamide anionic flocculants are characterized by molecular weights ranging between about 10 to about 24 million, and medium charge density (about 25-30% anionicity). It will be appreciated by those skilled in the art that various modifications (e.g., branched or straight chain modifications, charge density, molecular weight, dosage) to the flocculant may be contemplated.

As used herein, the term "coagulation" refers to a process of neutralizing repulsive electrostatic charge (often negative) surrounding particles to cause them to collide and agglomerate under the influence of Van der Waals's forces. As used herein, the term "coagulant" refers to a reagent which neutralizes repulsive electrical charges surrounding particles to cause the particles to agglomerate. The term includes organic and inorganic coagulants.

A suitable organic coagulant useful in the present invention includes, but is not limited to, a cationic polymeric coagulant. In one embodiment, the dosage of the cationic polymeric coagulant ranges between about 0 to about 1000 grams per tonne of solids in the tailings. In one embodiment, the cationic polymeric coagulant comprises polydimethyldiallylammonium chloride (or polydiallyldimethylammonium chloride (abbreviated as "polyDADMAC" and having a molecular formula of $C_8H_{16}NCl)_n$). In one embodiment, the polyDADMAC has a molecular weight ranging between about 6,000 to about 1 million, and a high charge density (about 100% cationicity). The monomer DADMAC is formed by reacting two equivalents of allyl chloride with dimethylamine. PolyDADMAC is then synthesized by radical polymerization of DADMAC with an organic peroxide used as a catalyst. Two polymeric structures are possible when polymerizing DADMAC: N-substituted piperidine structure or N-substituted pyrrolidine structure, with the pyrrolidine structure being favored. The polymerization process for polyDADMAC is shown as follows:

(1)

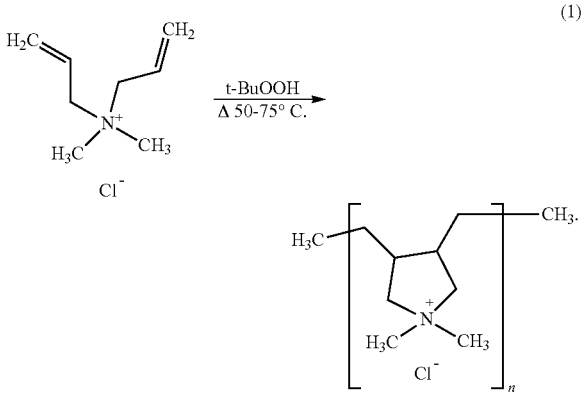

In one embodiment, cationic polymeric coagulants are more effective than inorganic cationic coagulants at the same dosages. However, suitable inorganic cationic coagulants useful in the present invention include, but are not limited to, alum, aluminum chlorohydrate, aluminum sulphate, lime (calcium oxide), slaked lime (calcium hydroxide), calcium chloride, magnesium chloride, iron (II) sulphate (ferrous sulphate), iron (III) chloride (ferric chloride), sodium aluminate, gypsum (calcium sulfate dehydrate), or any combination thereof. In one embodiment, the inorganic coagulants include multivalent cations. As used herein, the term "multivalent" means an element having more than one valence. Valence is defined as the number of valence bonds formed by a given atom. Suitable multivalent inorganic coagulants may comprise divalent or trivalent cations. Divalent cations increase the adhesion of bitumen to clay particles and the coagulation of clay particles, and include, but are not limited to, calcium ($Ca^{2+}$), magnesium ($Mg^{2+}$), and iron ($Fe^{2+}$). Trivalent cations include, but are not limited to, aluminium ($Al^{3+}$), iron ($Fe^{3+}$).

As used herein, the term "collector" refers to a reagent which increases the natural hydrophobicity of a negatively charged mineral surface, in particular, clays, quartz, feldspar, and the like, which are present in oil sand tailings, thereby decreasing the mineral's affinity to water. For example, such reagents can adsorb physically onto mineral surfaces that possess active sites having strong negative charge, thereby rendering the mineral surfaces less water loving (hydrophilic) and more water repelling (hydrophobic). A suitable collector comprises a cationic collector, including quaternary amines, such as dodecylpyridinium chloride (DPC), benzyldimethyldodecylammonium chloride (BDDA), and dodecyltrimethylammonium chloride (DTAC); ether amines, such as isodecyloxypropyl amine; and an ether diamine such as isodecyloxypropyl-1,3-diaminopropane.

A collector could also be an anionic collector in instances where the tailings have first been treated with hydrolyzed metal cations or cationic polymers. A suitable anionic collector includes, but is not limited to, sodium dodecyl sulfate (SDS), sodium oleate, sodium 1-dodecanesulfonate (SDF) and sodium hydroxamate (SHX). A suitable cationic polymer is a nano-hybride polymer (NHP). As used herein, "nano-hybrid polymer" or "NHP" means a charged particle-polymer hybrid comprised of a positively charged core (for example, $Al(OH)_3$ or $Fe(OH)_3$) having an average size of about 150 nm to about 800 nm and a polymer (e.g., polyacrylamide) polymerized thereon (see, for example, Canadian Patent Application No. 2,942,910).

As used herein, "rock-forming minerals" are minerals that are the building blocks of rocks, and generally include quartz, feldspar, mica, pyroxene, amphibole and olivine, but as used herein do not include clays. Rock-forming minerals found in oil sand tailings include quartz, ankerite, calcite, siderite, K-spar, plagioclase, pyrite, anatase and rutile.

As used herein, "clays" or "clay minerals" are flat hexagonal sheets comprised of clay minerals such as kaolinite, illite, and smectite. Clay minerals found in oil sand tailings include kaolinite, illite, chlorite, kaolinite (90)-smectite, and illite (77)-smectite.

The mineral composition of mature fine tailings or MFT of different size fractions is shown in Table 1.

TABLE 1

| | | Content, wt. % | |
|---|---|---|---|
| Mineral Group | Mineral Type | −10 μm fraction | −0.3 μm fraction |
| | Quartz | 27.9 ± 0.5 | 8.5 ± 0.6 |
| Carbonates | Ankerite | 0.6 ± 0.2 | 0.3 ± 0.2 |
| | Calcite | 1.8 ± 0.6 | 2.1 ± 1.1 |
| | Siderite | 5.2 ± 0.3 | 1.1 ± 0.4 |
| Feldspars | K-spar | 1.3 ± 0.4 | 1.9 ± 0.5 |
| | Plagioclase | 0.8 ± 0.3 | 0.7 ± 0.4 |
| | Pyrite | 0.4 ± 0.1 | 0.2 ± 0.1 |
| | Anatase | 1.0 ± 0.2 | 1.3 ± 0.2 |
| | Rutile | 0.6 ± 0.2 | 0.8 ± 0.3 |
| Clay minerals | Chlorite | 1.8 ± 0.5 | 2.2 ± 0.6 |
| | Kaolinite (90)-smectite* | n.a. | 7.5 ± 0.7 |
| | Kaolinite | 41 ± 0.7 | 41.6 ± 0.7 |
| | Illite (77)-smectite | 3.9 ± 0.7 | 16.7 ± 0.7 |
| | Illite | 14.0 ± 0.7 | 15.8 ± 0.7 |
| | Estimated total surface area ($m^2/g$) | 22 ± 1 | 86 ± 4 |

*i.e., 90% kaolinite and 10% smectite

As previously mentioned, the present invention relates generally to a process for improving the dewatering of tailings such as oil sand tailings comprising fine clays. With reference to FIG. 1, tailings 10 may be optionally diluted with water 12 to form a tailings feed having a preferred solids content of about 5 wt. % to about 35 wt. %, preferably 10 wt. % to 20 wt. %. In one embodiment, the tailings 10 can be optionally treated with a flocculant, a coagulant or both in a mixer 14, such as a dynamic mixer, T mixer, static mixer or continuous-flow stirred-tank reactor, to selectively increase the clay particle size. In one embodiment, the flocculant is APAM. In one embodiment, the coagulant is polyaluminum chloride. Mixing is conducted for a sufficient duration in order to allow the tailings and additives to combine properly and to ensure the efficiency of the additives.

The flocculant and/or coagulant treated tailings 16 (or untreated tailings 10) are treated with a collector 18 of the present invention, for example, a C12 quaternary amine, an ether amine or an ether diamine. The collector treated tailings are then subjected to froth flotation in a flotation cell or column 20. Air or carbon dioxide can be used as the gas phase for flotation. In one embodiment, $CO_2$ is used, as solids consolidation in the froth is improved due to easier collapse of $CO_2$ bubbles.

The froth 22 formed as a layer during flotation comprises both clay minerals and rock-forming minerals, which is then subjected to natural drainage and air drying in a containment cell 32, where the water 34 drains and the remaining solids are deposited in deposition site 38. In one embodiment, the froth 22 is dewatered in a liquid solids separator 30 known in the art, for example, pressure filter, belt filter, thickener, hydrocyclone and centrifugation. The dewatered froth 42 can then be deposited in deposition site 44 where further dewatering can occur. The water 42 produced during liquid solids separation can be used as recycle water. The water 24, produced during flotation, can either be used as recycle water or can be deposited into existing tailings ponds 26.

In one embodiment, tailings 10, which may be optionally diluted with water 12, are treated with a flocculant, coagulant, or both prior to treatment with collector 18. The thus treated tailings are then subjected to liquid solid separation in a liquid solids separator 46 such as a gravity separator, a thickener, a centrifuge, a filter press or a settling basin. The dewatered tailings can be directly deposited in a deposition site 52 and the water 48 can be used as recycle water.

Exemplary embodiments of the present invention are described in the following Examples, which are set forth to aid in the understanding of the invention, and should not be construed to limit in any way the scope of the invention as defined in the claims which follow thereafter.

Example 1

The first test performed to identify useful collectors for the present invention was the oil-solids attachment test. Oil-solids attachment test is a fundamental research method to quickly check if a collector is capable of rendering a mineral hydrophobic. The oil-solids attachment test procedure is described as follows. For each test, 40 ml diluted FFT with process water (having a natural pH of about 8.0-8.2), which gave 0.4-0.5 wt. % solid content, was put in a 4-oz glass jar. A given amount of collector solution was added into the jar, and mildly stirred, followed by adding 10 ml oil (hexadecane). While water soluble collectors were added directly into the water phase, the collectors which are difficult to be dissolved in water were added in the oil phase. The mixture was then shaken manually for 30 seconds. The prepared mixture was then poured into a 50-ml graduated cylinder for settling. The location of the interface with time was recorded. The hydrophobicity of the solids was evaluated by the stability of the formed oil-in-water emulsion and the interface rise velocity: the larger the volume of the emulsion zone, or the slower the rise velocity of the interface, or the less the solids remained in the water, the more hydrophobic of the solids are.

Since the oil droplets have a lower density of 770 kg/m$^3$ than water, if the solids are rendered hydrophobic, and truly attach to the oil droplets, forming stable oil/solid/water three-phase contact and oil in water emulsion, the hydrophobized solids will be carried to the top by the oil droplets, similar to flotation tests. Three different groups of cationic collectors were tested: C-12 quaternary amines having different functional groups; ether amines; and ether diamines.

Figure 2:
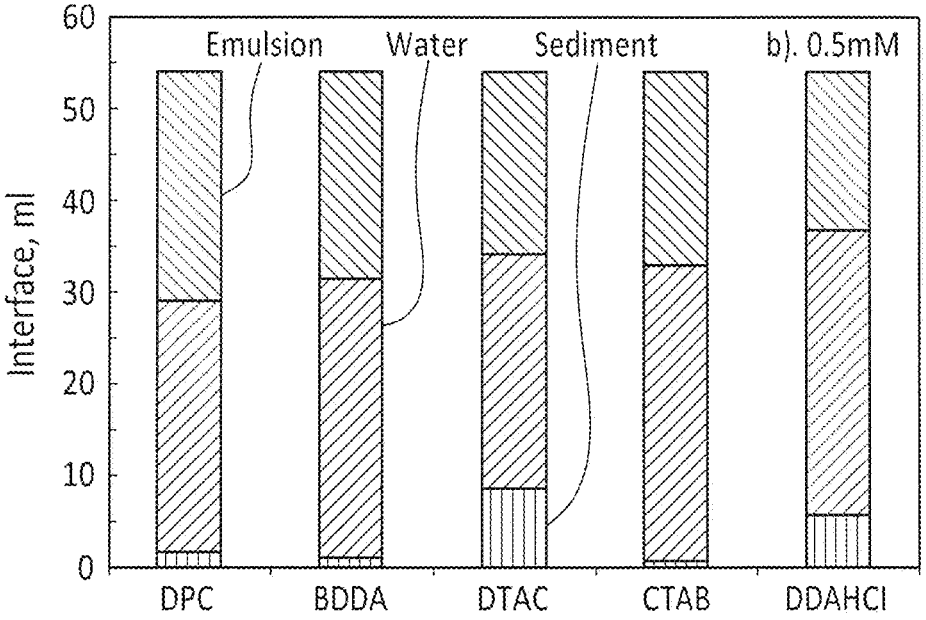
FIG. 2 is a bar graph showing the results of the oil-solids attachment test with collectors DPC, BDDA, DTAC, CTAB, and DDAHCL.

The quaternary amines tested were dodecylpyridinium chloride (DPC), benzyldimethyldodecylammonium chloride (BDDA), cetyltrimethylammonium bromide (CTAB) and dodecyltrimethylammonium chloride (DTAC). These quaternary amines were compared to acidified dodecylamine (DDA.HCL), which is a cationic collector that is specific for clays only. FIG. 2 is a bar graph which plots the interfaces (ml) of the sediment, water and emulsion for each of the cationic collectors tested. It can be seen from FIG. 2 that with DPC, BDDA and CTAB, the amount of emulsion, i.e., hydrophobized solids, was much greater than with acidified DDA, which is selective for clays only. Further, it can be seen that very little sediment was present with DPC, BDDA and CTAB, unlike with acidified DDA, where there was over 5 ml sediment, which likely represents the rock-forming minerals which were not rendered hydrophobic. Further, it would appear as well that DTAC was also selective for clays only, as it behaved much like acidified DDA.

Interestingly, DPC and BDDA, both of which are C-12 quaternary amines and have an aromatic ring as one of the functional groups, were the best at rendering all of the solids hydrophobic.

Figure 3:
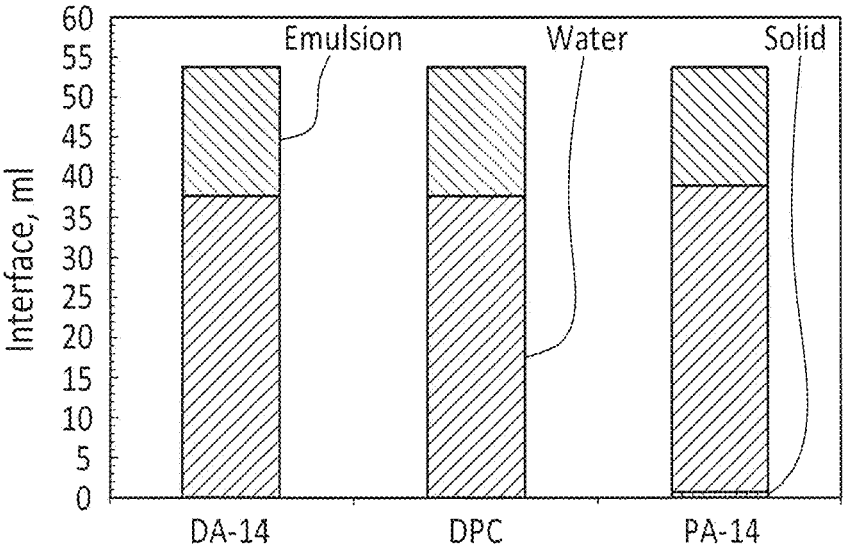
FIG. 3 is a bar graph showing the results of the oil-solids attachment test with collectors DA-14, DPC, and PA-14.

Ether amines/diamines were also tested for oil-solids attachment. In particular, the ether diamine isodecyloxypropyl-1,3-diaminopropane having the formula $CH_3$—$(CH_2)_{13}$—O—$(CH_2)_3$—NH—$(CH_2)_3$—$NH_2$ (available commercially from Evonik Corporation as Tomamine DA-14) and the ether amine isodecyloxypropyl amine having the formula $CH_3$—$(CH_2)_{13}$—O—$(CH_2)_3$—$NH_2$ (available commercially from Evonik Corporation as Tomamine PA-14) were tested and compared to the most efficient quaternary amine, DPC. FIG. 3 is a bar graph which plots the interfaces (ml) of the sediment (solids), water and emulsion for Tomamine DA-14, DPC and Tomamine PA-14. All three of these collectors rendered essentially all of the solids present in FFT hydrophobic. Only PA-14 showed a slight amount of sediment.

Figure 4:
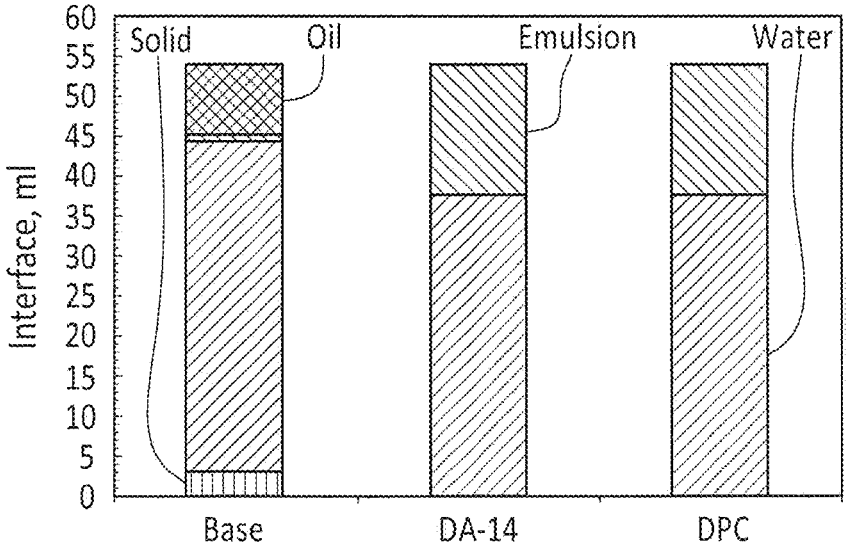
FIG. 4 is a bar graph showing the results of the oil-solids attachment test with collectors DA-14 and DPC when compared to base case where no collector was added.

FIG. 4 shows the oil-solids tests with ether diamine DA-14 and quaternary amine DPC at the dosage of 0.5 mM when compared with no chemical addition (base test). It can be seen that when no collector was used, a small amount of solids also entered into the upper oil phase. However, the solids could not form oil/solid/water three-phase contact and oil in water emulsion. This is clearly different from the other two tests with DA-14 and DPC in which there is no clear oil phase. These tests proved again DA-14 and DPC are good collectors for FFT solids.

Example 2

Based on the chemical screening test results obtained from the oil-solids attachment tests, FFT flotation verification tests were conducted. In the first test, fluid fine tailings feed having a total solids content of 12.6 wt. % was first treated with the flocculant SNF3338 (a polyacrylamide anionic flocculant characterized by molecular weights ranging between about 10 to about 24 million, and medium charge density (about 25-30% anionicity) at a dosage of 800 g/tonne FFT. The diluted FFT and flocculant were conditioned/mixed for approximately 0.5 minutes. The flocculant treated tailings were then treated with either DDA, DPC or DA-14 at a dosage of 650 g/tonne of tailings, and DPC or DA-14 at a dosage of 1000 g/tonne of tailings and conditioned for 2 minutes. The flocculant/collector treated tailings were then subjected to flotation for 15 minutes in a laboratory froth flotation cell (Denver flotation cell). A froth layer was floated to the top of the flotation device and a tails fraction, if any, formed at the bottom of the flotation device. The respective froths were placed in a bin and left to drain and air dry for 24 hours.

Figure 5:
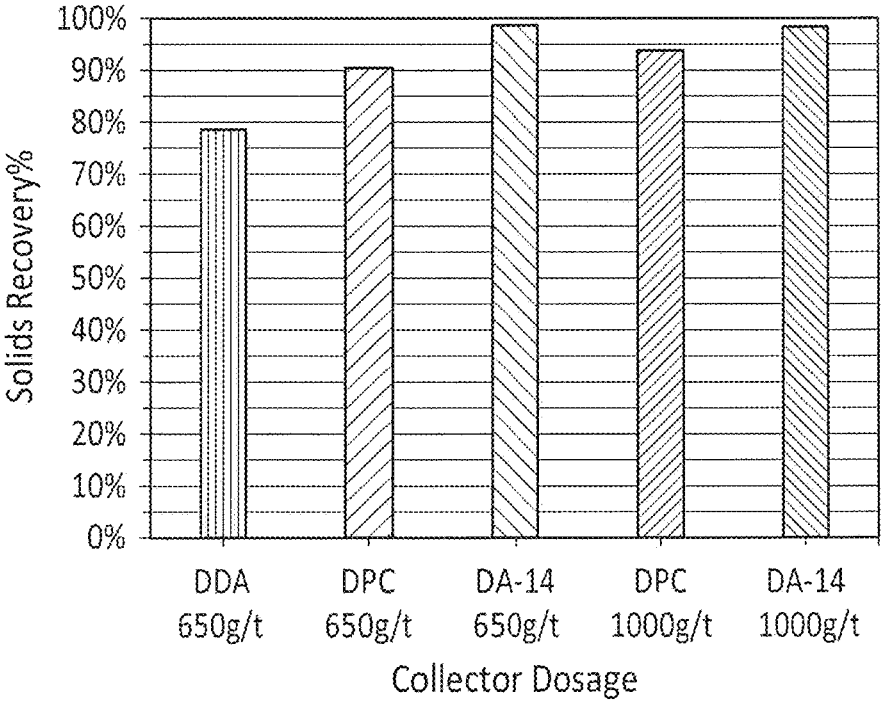
FIG. 5 is a bar graph showing the solids recovery (%) in flotation froth when using collectors DDA (650 g/tonne), DPC (650 g/tonne and 1000 g/tonne) and DA-14 (650 g/tonne and 1000 g/tonne).

As can be seen in FIG. 5, at the same collector dosage of 650 g/t, the solids recovery in froth was significantly increased from 78% with dodecylamine (DDA), which was prepared in acidified water at 35° C., the collector specific for clays only, to 90% with DPC and to 98% with DA-14. When the dosage increased to 1000 g/t, the solids recovery in froth was increased to 94% with DPC. However, the solids recovery with DA-14 was maintained at 98% at the dosage of 1000 g/t. The ether diamine DA-14 performed better with a higher solids recovery than the quaternary amine DPC.

Figure 6:
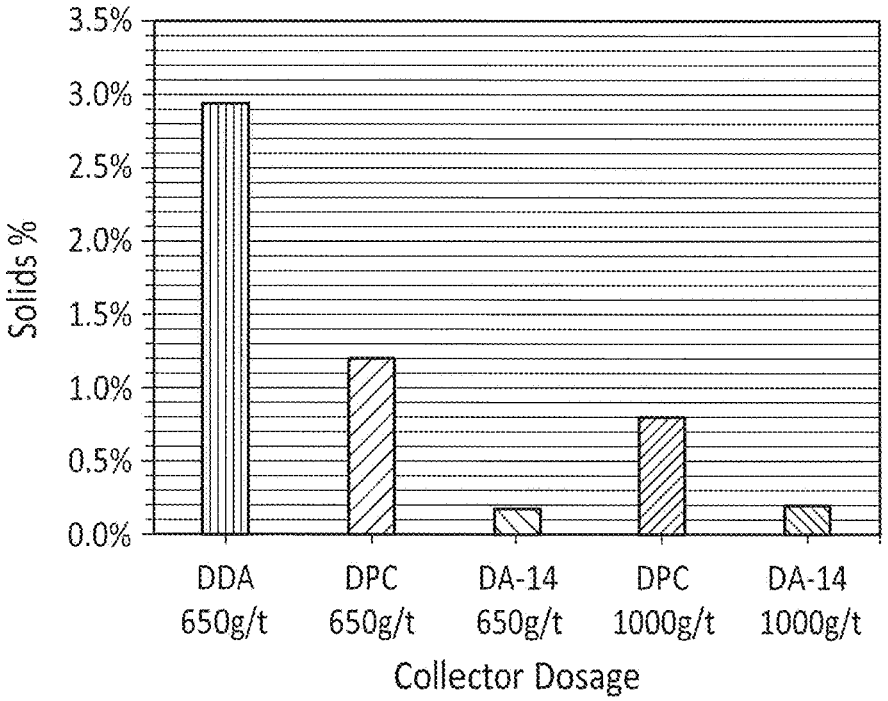
FIG. 6 is a bar graph showing the solids content (%) in flotation tails when using collectors DDA (650 g/tonne), DPC (650 g/tonne and 1000 g/tonne) and DA-14 (650 g/tonne and 1000 g/tonne).

FIG. 6 shows that when clay selective collector DDA was used, the solids content remaining in the flotation tails was about 3%. However, with DPC at 650 g/tonne and 1000 g/tonne, the solids content in the flotation tails was reduced to about 1.2% and 0.8%, respectively, indicating that DPC was reacting with both the clays and rock-forming minerals. DA-14 proved to be an even better collector for clays and rock-forming minerals. At 650 g/tonne DA-14, the solids content in the flotation tails was less than 0.2% solids.

Example 3

In this example, the negatively charged clays and rock-forming minerals were first treated with hydrolyzed metal cations to see whether anionic collectors could then be used. Activation of anionic collector adsorption onto negatively charged solids by hydrolyzed metal cations depends on the formation of mono metal hydroxyl ions $MOH^+$ onto the solid surfaces, thereby providing positive charge sites on the solids to induce and attract the adsorption of anionic collectors on the solids. Therefore, metal cations, which could reduce the negativity of solid Zeta potentials in a larger degree, or the more positively charged solids, would favor solid hydrophobization by adsorbing anionic collector.

Based on the Zeta-potential measurement data, the capability of decreasing the negativity of the FFT solid surface charges by the tested metal cations can be ranked as below:

$$Fe^{2+}>Zn^{2+}>Ni^{2+}>Mn^{2+}>Ca^{2+}>Mg^{2+}$$

It is expected that $Fe^{2+}$ would have the strongest power to activate the FFT solids on which an anionic collector can be most favorably absorbed and render them hydrophobic.

Figure 7:
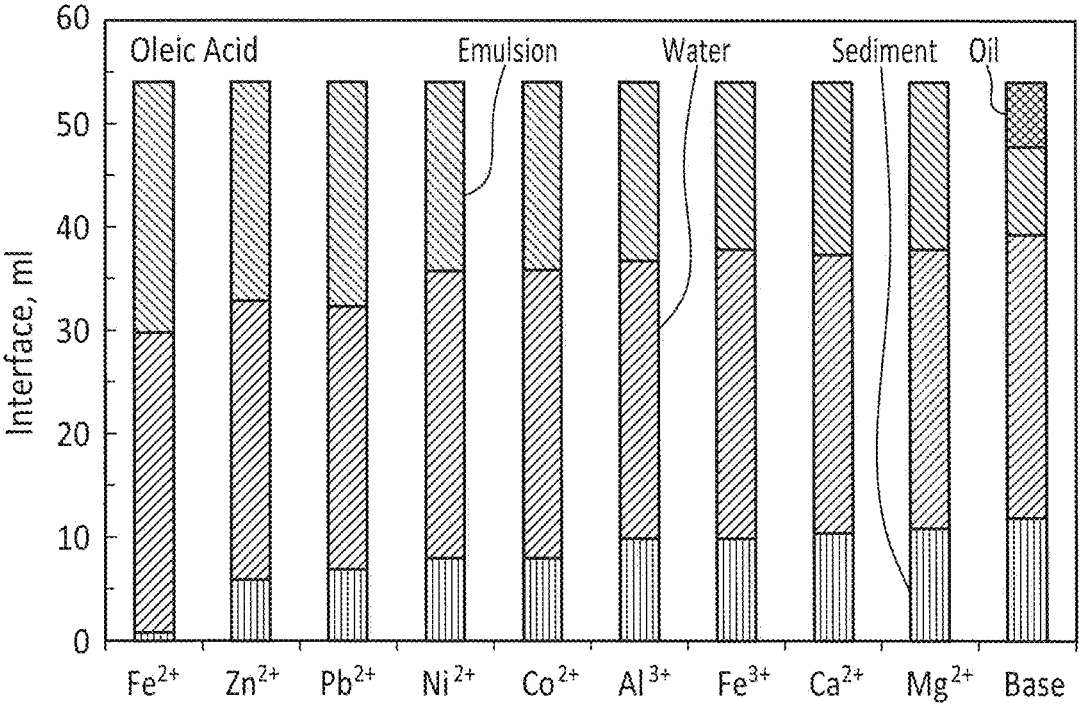
FIG. 7 is a bar graph of an oil-solids attachment test with different metal cations and C-18 oleic acid.

Similar oil-solids attachment tests were conducted using diluted FFT as described above. In this series of tests, the metal cation was first mixed with the diluted FFT slurry before mixing with the anionic collector and the oil. The anionic collectors include alkyl carboxylate, alkyl sulphonate and sulphate categories. FIG. 7 shows the oil-solids attachment tests with different metal cations at the dosage of 1 mM and C-18 oleic acid at the dosage of 3 mM. C-18 oleic acid belongs to the carboxylate category of anionic collectors. It can be seen that when the metal cation in $Fe^{2+}$, essentially all of the solids associated with the oil, indicating that essentially all solids, i.e., clay minerals and rock-forming minerals, were rendered hydrophobic.

Thus, based on the results in FIG. 7, the capability of metal cations in inducing FFT solids attaching to oil droplets, or activating solid hydrophobization, can be ranked as:

$$Fe^{2+}>Zn^{2+}>Pb^{2+}>Ni^{2+}>Co^{2+}>Al^{3+}>Fe^{3+}>Ca^{2+}>Mg^{2+}>\text{no chemical}$$

It is proved $Fe^{2+}$ is the strongest in activating the anionic collector adsorption and rendering all of the FFT solids hydrophobic, which is consistent with the Zeta-potential measurement results. To verify the reproducibility of the above sequence, further tests were carried out using another anionic collector, C-12 fatty acid (lauric acid). Again, a similar sequence to the above results was obtained, further confirming the trend of the capability of hydrolyzed metal cations in activating FFT solids hydrophobization by adsorbing anionic collector. The only difference is that C-18 oleic acid is relatively stronger than C-12 fatty acid in collecting capacity as C-18 oleic acid has a longer carbon chain length than C-12 fatty acid.

Figure 8:
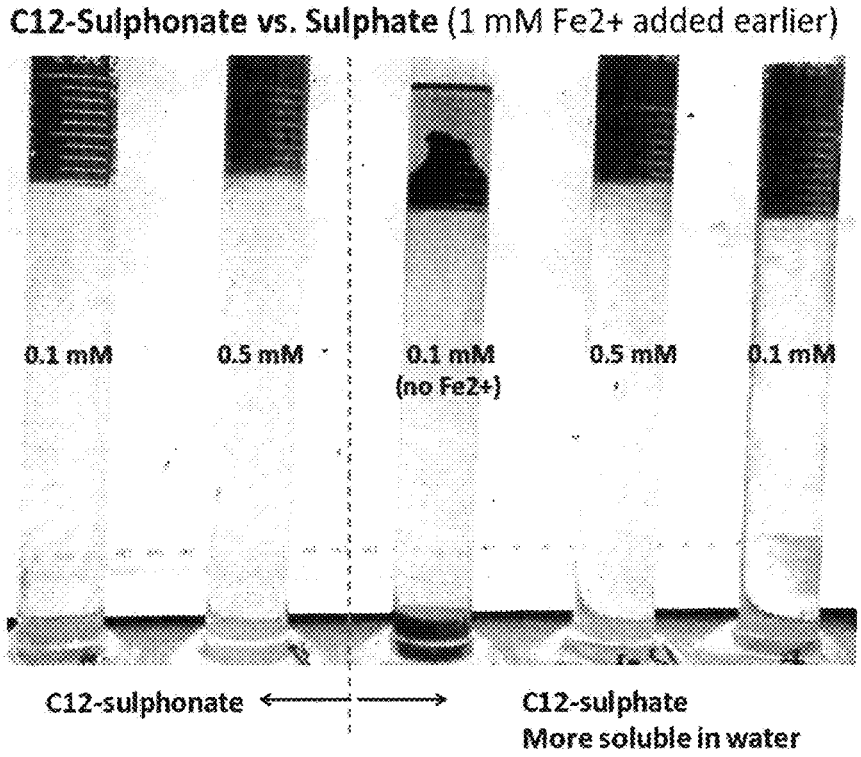
FIG. 8 is a photograph of an oil-solids attachment test using $Fe^{2+}$ and C-12 sulphonate or C-12 sulphate.

FIG. 8 shows the oil-solids attachment tests with C-12 sulphonate or C-12 sulphate in the presence or absence of $Fe^{2+}$. The purpose of the tests was to expand the application of anionic collectors to the alkyl sulphonate and alkyl sulphate categories. It is clear, in the absence of $Fe^{2+}$, the C-12 sulphate at 0.1 mM cannot make the FFT solids hydrophobic. In the presence of 1 mM $Fe^{2+}$, both C-12 sulphonate and C-12 sulphate at 0.1 and 0.5 mM dosages can render the FFT solids hydrophobic. It is noticed that in the presence of 1 mM $Fe^{2+}$, the effective dosage of alkyl C-12 sulphonate or C-12 sulphate is only 0.1-0.5 mM compared with C-18 oleic acid or C-12 fatty acid at 3 mM. Although the dosages of the anionic collectors need to be optimized, C-12 sulphonate or C-12 sulphate shows a stronger collecting capacity than the carboxylate collectors do.

Example 4

Froth flotation tests were performed in a 2-L Denver flotation cell using a nano-hybrid polymer (NHP) to first treat the negatively charged clays and rock-forming minerals, followed by treatment with an anionic collector, in particular, sodium oleate. FFT was diluted to 12.5 wt % by adding process water and mixed by agitation at 1000 rpm for 2 minutes. During agitation, various dosages of NHP and sodium oleate were added to the FFT. Compressed air was injected at a flowrate of 1-L/min into the flotation cell. The collected froth samples were weighed, dried in an oven overnight, and the solids recovery calculated based on the weight ratio of the floated dry solids to the original dry solids in the FFT feed.

Figure 9:
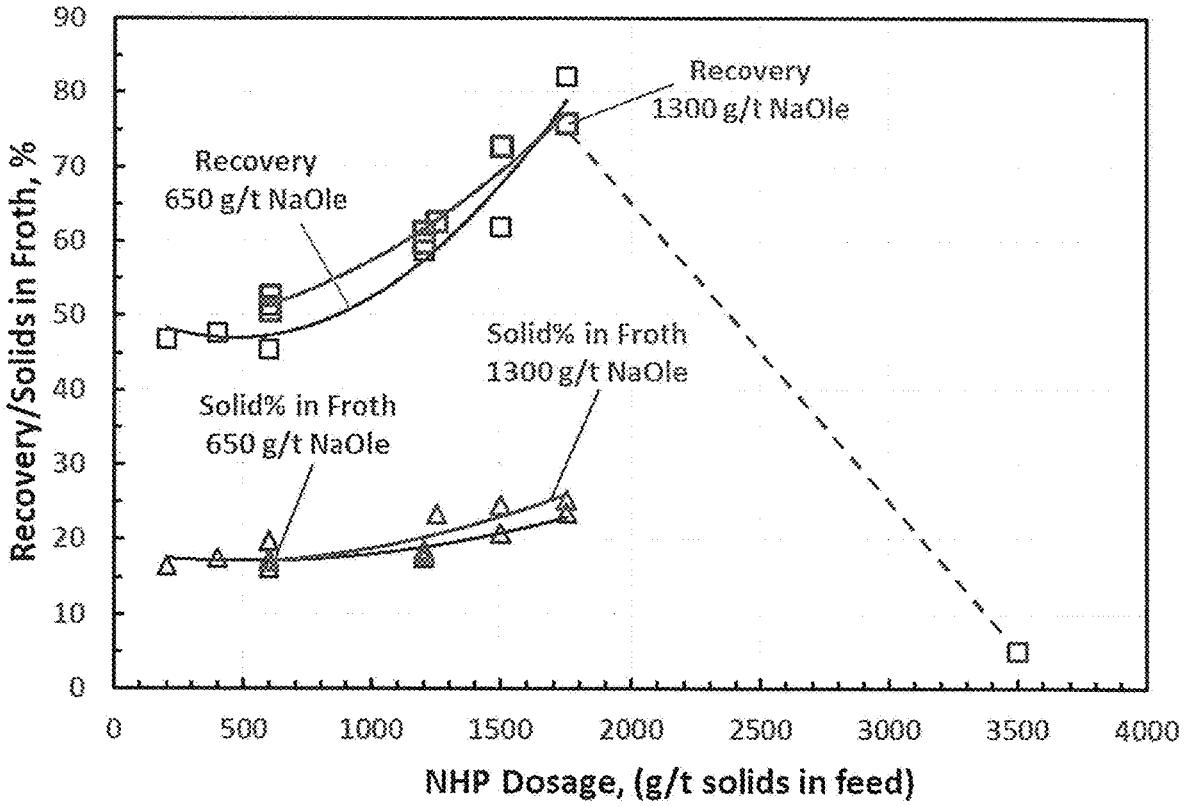
FIG. 9 is a graph showing the effect of nano-hybrid polymer (NHP) dosage on solids recovery (%) in froth flotation of FFT using the anionic collector sodium oleate (NaOle).

FIG. 9 shows the solid recovery and the solids content in the froth with increasing NHP dosages using sodium oleate (NaOle) as anionic collector at a dosage of 650 g/t and 1300 g/t of dry solids in FFT respectively. Both recovery and froth solid content increased with increasing NHP dosage to 1750 g/t. A solid recovery of over 80% and solid content in the froth >20% could be obtained. It can be noted that at the NHP dosage between 200-1500 g/t, increasing NaOle dosage from 650 to 1300 g/t slightly increased both solid recovery and solids content in the froth. However, further increasing NHP dose to 1750 g/t resulted in a lower solid recovery at a higher collector dose (1300 g/t NaOle) than at a lower NaOle dose (650 g/t), with the solid content in the froth continuing increase. Since the collector dose is fixed (650 vs. 1300 g/t), it can be conceived that the solid hydrophobicity could be stronger in the case of 1300 vs. 650 g/t NaOle. In other words, it is possible the average aggregate sizes were larger in the case of 1300 g/t than at 650 g/t NaOle, enhancing hydrophobic coagulation of the solids more effectively at 1300 g/t NaOle. Because of enlarged solid aggregate sizes, hydrodynamic conditions in the mechanical flotation cell could disrupt solid aggregate-bubble attachment, resulting in the solids detaching from the bubbles and reduced solid recovery. To confirm the finding and verify the above analysis, a flotation test was run by increasing NHP dose to 3500 g/t and NaOle at 1300 g/t. It was noted during the tests that the water became clear. However, there were virtually no solids coming to the top froth. Only about 5% solids could be collected, because of the "heavy" aggregates settling at the bottom. Therefore, it is necessary to find out the optimum concentration ranges of NaOle and NHP.

Figure 10:
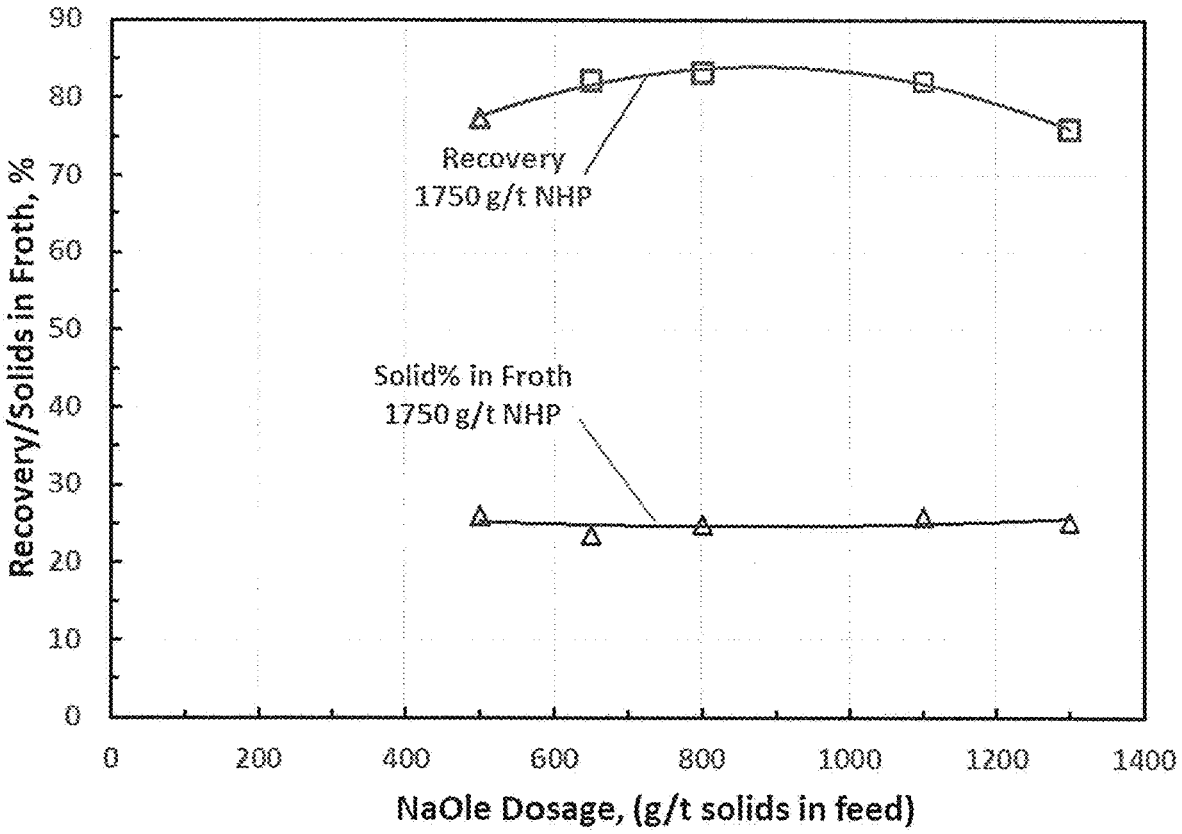
FIG. 10 is a graph showing the effect of dosage of the anionic collector sodium oleate (NaOle) on solids recovery (%) in froth flotation of FFT when the FFT is treated with 1750 g/t NHP.

To further verify that the enlarged solid aggregates by both cationic flocculation and hydrophobic coagulation were responsible for the drop in solid recovery at higher dosages, effect of NaOle concentration on solid recovery was examined by fixing the NHP dose at 1750 g/t. The results in FIG. 10 show that a maximum recovery of 83% was obtained at the NaOle dose of 800 g/t. It appeared that the optimum concentration range of NaOle could be in the range of 800-1000 g/t for the solid recovery to reach maximum. In addition, the solid content in the froth reach up to 26%, more than double the original solid content in the feed.

Based on the results shown in FIGS. 9 and 10, and the above discussion, it appears that, using NaOle at a dose of 650-1000 g/t and NHP dose between 1750-3500 g/t, it could be possible to push the recovery to 90% or higher.

Figure 11A:
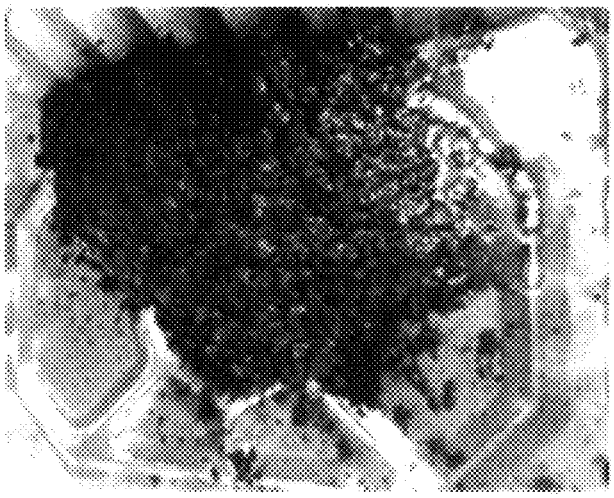
FIG. 11A is a photograph of flotation froth when using NHP and sodium oleate (NaOle).
Figure 11B:
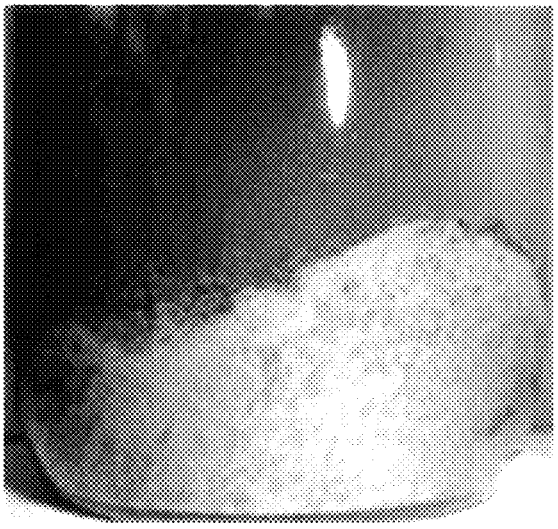
FIG. 11B is a photograph of flotation tailings when using NHP and sodium oleate (NaOle).

An interesting phenomenon was found during flotation tests using NHP and NaOle. When both chemicals reached certain dosages, the tailings after flotation (flotation tailing) showed an obvious separation of coarse silica from the aggregated fine clays in FFT. The bottom of the bottle containing the tailings showed a layer of white coarse sands which could observed by naked eyes (see FIG. 11A). The flotation froth fluid became very clean, as can be seen in FIG. 11B. Such phenomenon was not observed by adding anionic flocculant SNF3338.

Example 5

In Example 4 above, the improved FFT flotation in the presence of NHP and anionic collector is hypothesized to be attributable to the increased solid hydrophobicity and enlarged solid aggregates sizes. To confirm this hypothesis, hydrophobic coagulation and filtration tests were conducted to appreciate the effect of NHP on activating collector adsorption on solids and enlarging the apparent aggregate sizes.

Figure 12A:
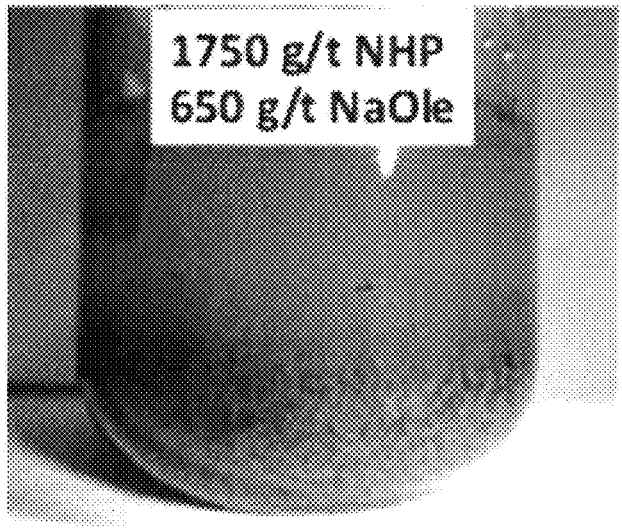
FIG. 12A is a photograph showing coagulation and settling of FFT solids in the presence of 1750 g/t NHP and 650 g/t NaOle.
Figure 12B:
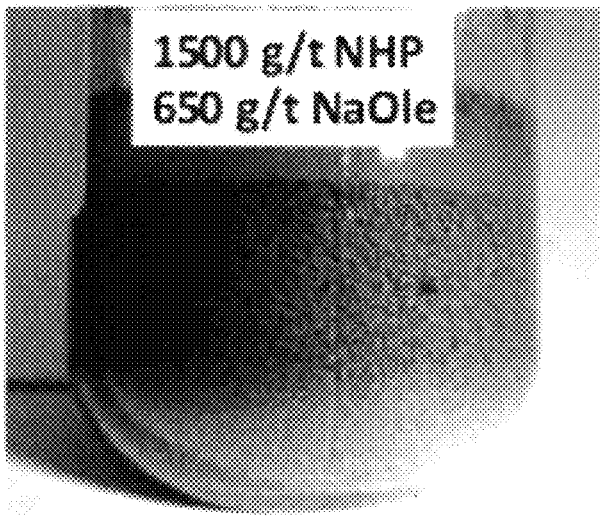
FIG. 12B is a photograph showing coagulation and settling of FFT solids in the presence of 1500 g/t NHP and 650 g/t NaOle.

Hydrophobic coagulation is commonly used in mineral processing to enlarge apparent particle sizes for accelerated flotation. By adding collector into the ore slurry, the targeted solids are rendered hydrophobic by adsorbing the collector. The hydrophobized solids coagulate by hydrophobic interaction under given intensity of mixing, enlarging the aggregate size. To confirm such action, simple coagulation tests without carrying out flotation were conducted, by using the same chemical recipes which gave the best flotation performance, that is, adding the given amount of cation activator NHP and collector sodium oleate (NaOle) to FFT. It can be seen in FIGS. 12A and 12B that the formed aggregates are visible by the naked eye and solid-liquid separation was effected.

Figure 13:
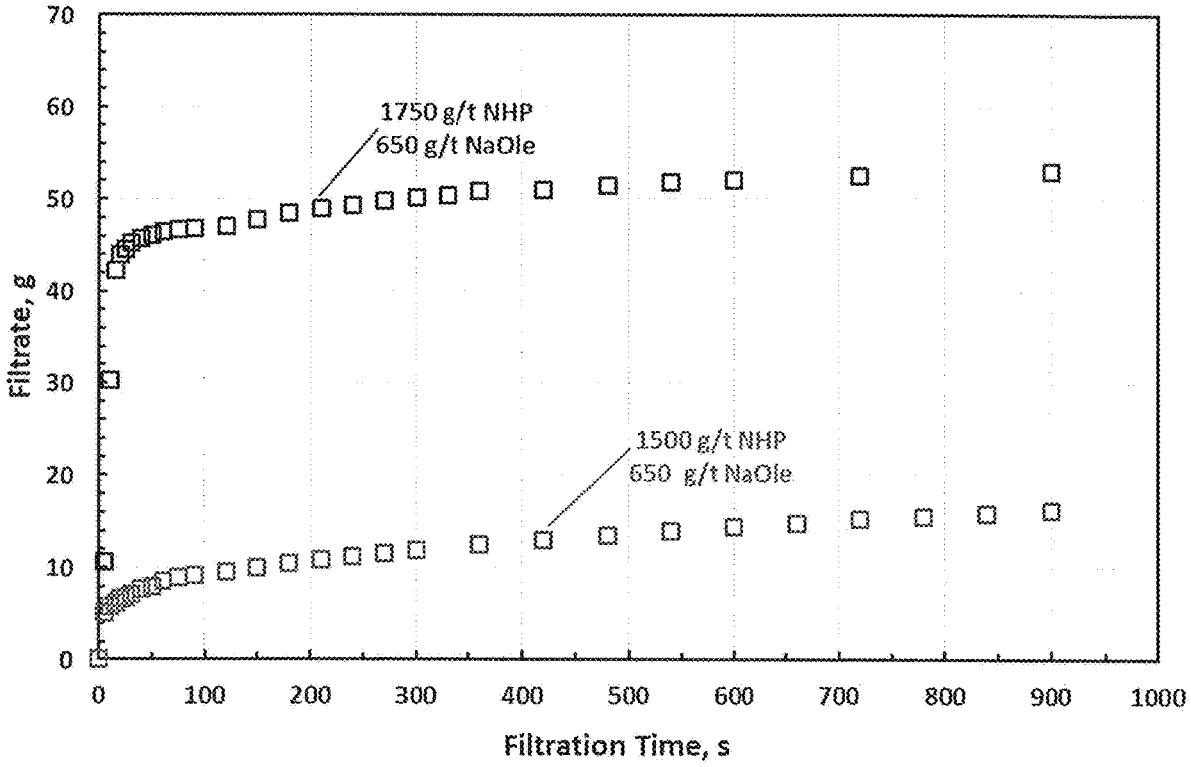
FIG. 13 is a graph showing the weight of filtrate versus the filtration time required to filter FFT solids in the presence of NHP and NaOle.

The role of NHP in activating collector adsorption and enlarged aggregate sizes can be further confirmed using filtration tests. For filtration tests, a small laboratory BHS pressure filter was used for filtration at a fixed air pressure of 50 psi. The filtrate was collected in a beaker placed on an electronic balance, and the weight was recorded with time. As can be seen in FIG. 13, which plots weight of filtrate versus filtration time in seconds (s), using NHP as the activator is very effective in dewatering the FFT by filtration. Within less than 100 seconds, almost all the water was filtered out when adding 1750 g/t NHP as cation activator and 650 g/t NaOle as collector. However, reducing the NHP to 1500 g/t reduced the filtration rate significantly. One of the main reasons for such a difference could be attributed to reduced aggregate sizes with decreased dosages.

Example 6

In this Example, the effect of solids content of the FFT was studied. Generally, to improve the operation capacity of flocculation, flotation and dewatering, a high solid content is preferred. Accompanied by the increased solids in the slurry, however, is the need of increasing chemical dosages, meaning that the chemicals could reduce their effectiveness with increasing solids content. To evaluate the effect of solids content in the feed on dewatering, different solid content FFT samples were prepared (12.5%, 15.0%, 20.0% and 25.0%). In this set of tests, the required chemical dosages were determined based on the fact that clean silica was segregated out and visible at the bottom. In all the prepared samples, the amount of the FFT solids was the same (27 g). The difference was the amount of water and NHP added. In all tests, 650 g/t NaOle was used.

Figure 14A:
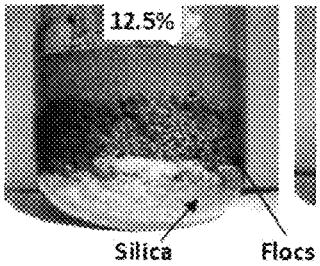
FIGS. 14A, 14B, 14C and 14D are photographs showing coagulation and settling of FFT solids having a solids content of 12.5%, 15.0%, 20.0% and 25.0%, respectively, in the presence of NHP and NaOle.
Figure 14B:
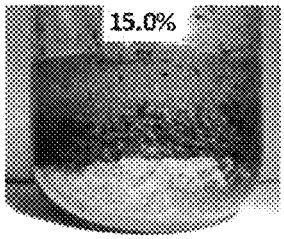
Figure 14C:
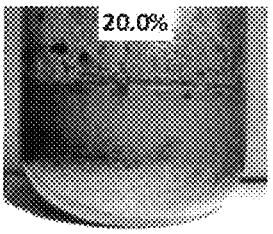
Figure 14D:
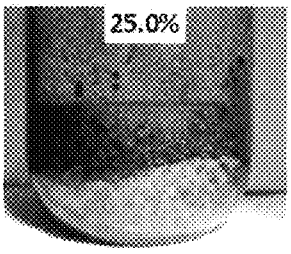

In FIG. 14A, the solids content was 12.5% and 1750 g/t NHP was used. In FIG. 14B, the solids content was 15.0% and 1750 g/t NHP was used. In FIG. 14C, the solids content was 20.0% and 1896 g/t NHP was used. In FIG. 14D, the solids content was 25.0% and 2330 g/t NHP was used. As shown in FIGS. A-D, higher doses of NHP were needed for the higher solids content.

Figure 15:
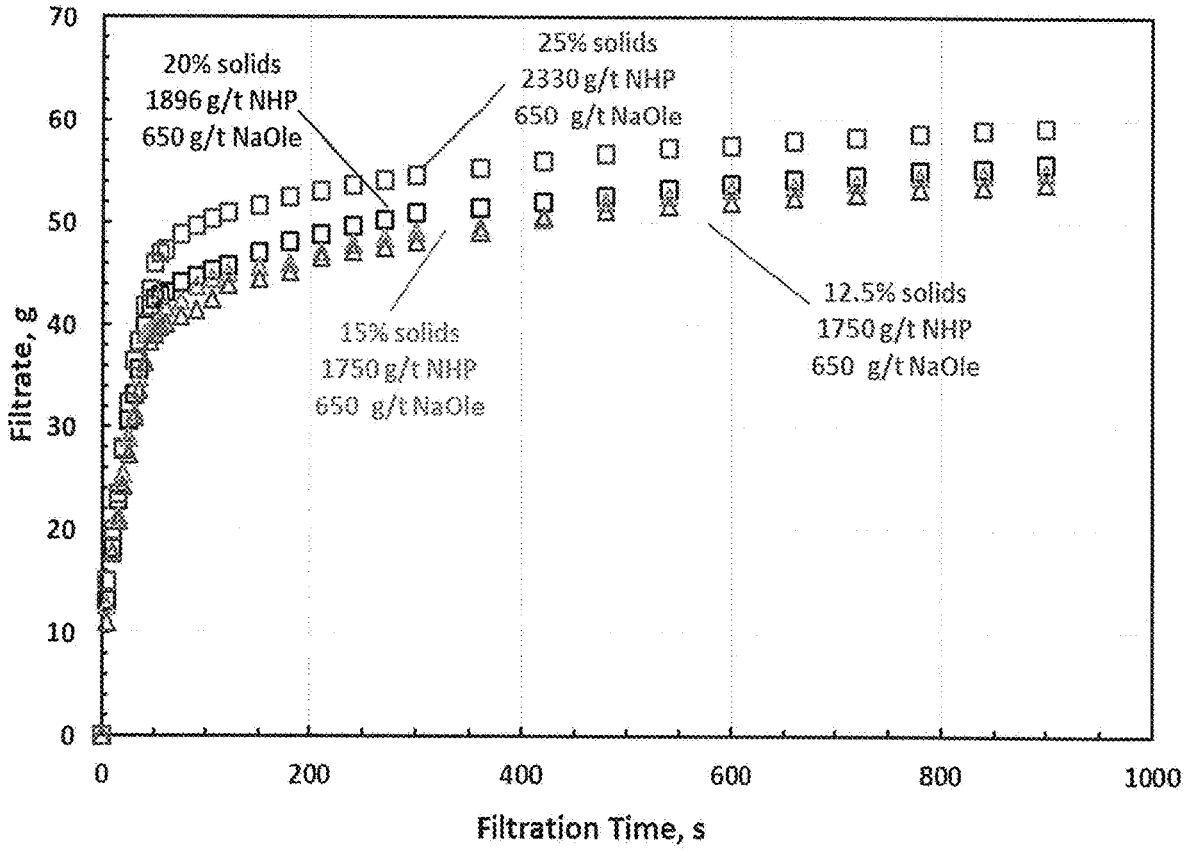
FIG. 15 is a graph showing the weight of filtrate versus the filtration time required to filter FFT solids having a solids content of 12.5%, 15.0%, 20.0% and 25.0%, respectively, in the presence of NHP and NaOle.

Filtration tests with these prepared samples were also run. The results in FIG. 15 show a slightly faster filtration rate was observed for the sample with a higher solid content, although all the samples contained the same amount of solids. One of the reasons could be attributed to the slightly higher NHP doses added, which could produce slightly larger aggregates than those at a lower NHP doses.

References in the specification to "one embodiment", "an embodiment", etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such module, aspect, feature, structure, or characteristic with other embodiments, whether or not explicitly described. In other words, any module, element or feature may be combined with any other element or feature in different embodiments, unless there is an obvious or inherent incompatibility, or it is specifically excluded.

It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition or step being referred to is an optional (not required) feature of the invention.

The singular forms "a," "an," and "the" include the plural reference unless the context clearly dictates otherwise. The term "and/or" means any one of the items, any combination of the items, or all of the items with which this term is associated. The phrase "one or more" is readily understood by one of skill in the art, particularly when read in context of its usage.

The term "about" can refer to a variation of ±5%, ±10%, ±20%, or ±25% of the value specified. For example, "about 50" percent can in some embodiments carry a variation from 45 to 55 percent. For integer ranges, the term "about" can include one or two integers greater than and/or less than a recited integer at each end of the range. Unless indicated otherwise herein, the term "about" is intended to include values and ranges proximate to the recited range that are equivalent in terms of the functionality of the composition, or the embodiment.

As will be understood by one skilled in the art, for any and all purposes, particularly in terms of providing a written description, all ranges recited herein also encompass any and all possible sub-ranges and combinations of sub-ranges thereof, as well as the individual values making up the range, particularly integer values. A recited range includes each specific value, integer, decimal, or identity within the range. Any listed range can be easily recognized as sufficiently describing and enabling the same range being broken down into at least equal halves, thirds, quarters, fifths, or tenths. As a non-limiting example, each range discussed herein can be readily broken down into a lower third, middle third and upper third, etc.

As will also be understood by one skilled in the art, all language such as "up to", "at least", "greater than", "less than", "more than", "or more", and the like, include the number recited and such terms refer to ranges that can be subsequently broken down into sub-ranges as discussed above. In the same manner, all ratios recited herein also include all sub-ratios falling within the broader ratio.

The invention claimed is:

1. A process for treating and dewatering tailings comprising fine clay minerals, fine rock-forming minerals and water, the fine rock-forming minerals comprising at least one of quartz, a carbonate mineral and feldspar, comprising:

(a) treating the tailings with a sufficient amount of a collector to increase the hydrophobicity of both the fine clays minerals and the rock-forming minerals;

(b) subjecting the treated tailings to froth flotation to form a fine clay minerals and the rock-forming minerals froth layer; and (c) recovering the froth layer and subjecting it to dewatering.

2. The process as claimed in claim 1, wherein the froth layer is subjected to dewatering in step (c) by drainage and air drying.

3. The process as claimed in claim 1, wherein the collector is a quaternary amine, an ether amine or an ether diamine.

4. The process as claimed in claim 1, further comprising pre-treating the tailings with a flocculant, a coagulant or both prior to treatment with the collector in step (a).

5. The process as claimed in claim 4, wherein, when the tailings are pre-treated with the flocculant, the flocculant is an anionic polyacylamide or a cationic polymer.

6. The process as claimed in claim 4, wherein, when the tailings are pre-treated with the coagulant, the coagulant is polyaluminum chloride.

7. The process as claimed in claim 1, wherein the froth layer is subjected to dewatering in step (c) by liquid solids separation in a gravity separator, a thickener, a centrifuge or a settling basin.

8. The process as claimed in claim 1, wherein the tailings is a fluid fine tailings.

9. The process as claimed in claim 1, wherein the tailings are fine tailings produced during bitumen extraction of oil sands.

10. The process as claimed in claim 1, wherein the collector is selected from the group consisting of dodecylpyridinium chloride (DPC), benzyldimethyldodecylammonium chloride (BDDA), cetyltrimethylammonium bromide (CTAB), isodecyloxypropyl-1,3-diaminopropane (DA-14) and isodecyloxypropyl amine (PA-14).

11. A process for treating and dewatering oil sand tailings comprising fine clay minerals, fine rock-forming minerals and water, the fine rock-forming minerals comprising at least one of quartz, a carbonate mineral and feldspar, comprising:

(a) treating the oil sand tailings with a sufficient amount of a metal cation to render the fine clay minerals and the fine rock-forming minerals positively charged and form a first treated tailings;

(b) treating the first treated tailings with a sufficient amount of an anionic collector to render the positively charged fine clay minerals and the rock-forming minerals present in the first treated tailings hydrophobic and form a second treated tailings;

(c) subjecting the second treated tailings to froth flotation to form a fine clay minerals and rock-forming minerals froth layer; and (d) recovering the froth layer and subjecting the froth layer to dewatering.

12. The process as claimed in claim 11, wherein the metal cation is $Fe^{2+}$.

13. The process as claimed in claim 11, wherein the anionic collector is sodium oleate.

14. A process of treating and dewatering oil sand tailings comprising fine clay minerals, rock-forming minerals, and water, the fine rock-forming minerals comprising at least one of quartz, a carbonate mineral and feldspar, comprising:

(a) treating the oil sand tailings with a sufficient amount of a cationic polymer to render the fine clay minerals and the fine rock-forming minerals positively charged and form a first treated tailings;

(b) treating the first treated tailings with a sufficient amount of an anionic collector to render the positively charged fine clay minerals and the rock-forming minerals present in the first treated tailings hydrophobic and form a second treated tailings;

(c) subjecting the second treated tailings to froth flotation to form a fine clay minerals and rock-forming minerals froth layer; and (d) recovering the froth layer and subjecting the froth layer to dewatering.

15. The process as claimed in claim 13, wherein the anionic collector is a C-18 fatty acid or a C-12 fatty acid.

16. The process as claimed in claim 14, wherein the cationic polymer is a nano-hybrid polymer (NHP) and the anionic collector is sodium oleate.

* * * * *